US007297074B2

(12) United States Patent
Kumamoto

(10) Patent No.: US 7,297,074 B2
(45) **Date of Patent: *Nov. 20, 2007**

(54) GOLF CLUB HEAD

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/879,197

(22) Filed: Jun. 30, 2004

(65) Prior Publication Data

US 2005/0026723 A1 Feb. 3, 2005

(30) Foreign Application Priority Data

Jul. 31, 2003 (JP) ..... 2003-204764
Apr. 27, 2004 (JP) ..... 2004-131712

(51) Int. Cl.
*A63B 53/04* (2006.01)

(52) U.S. Cl. ..... 473/345; 473/348

(58) Field of Classification Search ..... 473/324–350
See application file for complete search history.

(56) References Cited

U.S. PATENT DOCUMENTS 5,509,659 A * 4/1996 Igarashi ..... 473/345
5,536,011 A * 7/1996 Gutowski ..... 473/350
5,665,014 A * 9/1997 Sanford et al. ..... 473/345
6,183,377 B1 * 2/2001 Liang ..... 473/324
6,623,378 B2 * 9/2003 Beach et al. ..... 473/345
6,663,504 B2 * 12/2003 Hocknell et al. ..... 473/329
7,128,662 B2 * 10/2006 Kumamoto ..... 473/345

FOREIGN PATENT DOCUMENTS

JP 5-51374 U 7/1993
JP 2003-62130 A 3/2003
JP 2004121395 A * 4/2004

OTHER PUBLICATIONS

Definition of "hole", Merriam-Webster, www.m-w.com.*

* cited by examiner

*Primary Examiner*—Eugene Kim
*Assistant Examiner*—Alvin A Hunter
(74) *Attorney, Agent, or Firm*—Birch, Stewart, Kolasch & Birch, LLP

(57) ABSTRACT

A hollow golf club head which is composed of a metal part made of at least one kind of metal material and a FRP part made of a fiber reinforced resin, the metal part having a first lap joint part, and the FRP part having a second lap joint part being lap-jointed with the first lap joint part, wherein one of the first lap joint part and second lap joint part is provided with at least one securing hole, and the other is provided with at least one protrusion engaging with said at least one securing hole.

20 Claims, 11 Drawing Sheets

GOLF CLUB HEAD

This Non-provisional application claims priority under 35 U.S.C. § 119(a) on Patent Application No(s). 2003-204764 and 2004-131712 filed in Japan on Jul. 31, 2003 and Apr. 27, 2004 respectively, the entire contents of which are hereby incorporated by reference.

BACKGROUND OF THE INVENTION

The present invention relates to a golf club head, more particularly to a joint structure of a metal part made of a metal material and a FRP part made of a fiber reinforced resin.

In recent years, golf club heads made of a metal material and fiber reinforced resin have been proposed.

The laid-open Japanese utility model application JP-U5-51374 discloses a club head made of a metal material or a fiber reinforced resin, wherein the crown portion is cut out to form a window which can be either left opened or closed by a cover made of a lower specific gravity material.

The laid-open Japanese patent application JP-P2003-62130A discloses a club head formed by integrating a face component made of a metal material and having a turnback along the edge thereof, and an aft-body made of a plurality of plies of prepreg. As shown in FIG. 21, the turnback (a1) of the face component (a) and the front edge portion (b1) of the aft-body (b) are spliced.

In a golf club head having such a spliced structure, the spliced portion is subjected to a large sharing force as the face portion receives a large impact force, and the bonded surface is very liable to come unstuck. This is especially true in case of a large-sized hollow golf club head such as wood-type golf club heads because the wall thickness is thin and thus deformation at impact is relatively large.

SUMMARY OF THE INVENTION

It is therefore, an object of the present invention to provide a golf club head, in which the joint portion is increased in the strength, and thereby the durability of the club head is improved.

According to one aspect of the present invention, a hollow golf club head is composed of a metal part made of at least one kind of metal material and a FRP part made of a fiber reinforced resin, the metal part having a first lap joint part, and the FRP part having a second lap joint part being lap-jointed with the first lap joint part, wherein one of the first lap joint part and second lap joint part is provided with at least one securing hole, and the other is provided with at least one protrusion engaging with the at least one securing hole.

Therefore, the strength of the lap joint is greatly increased by the mechanical engaging force between the securing hole and protrusion in addition to the bonding force which will be generated between the surface of the metal part and the surface of the FRP part by means of an adhesive agent, welding (melting) of the matrix resin or the like. Thus, the durability of the club head can be improved, and a further decrease in the material thickness becomes possible which will lead to not only a weight reduction but also a possibility of a large elastic deformation at impact to improve the rebound performance.

DESCRIPTION OF THE PREFERRED EMBODIMENTS

Figure 1:
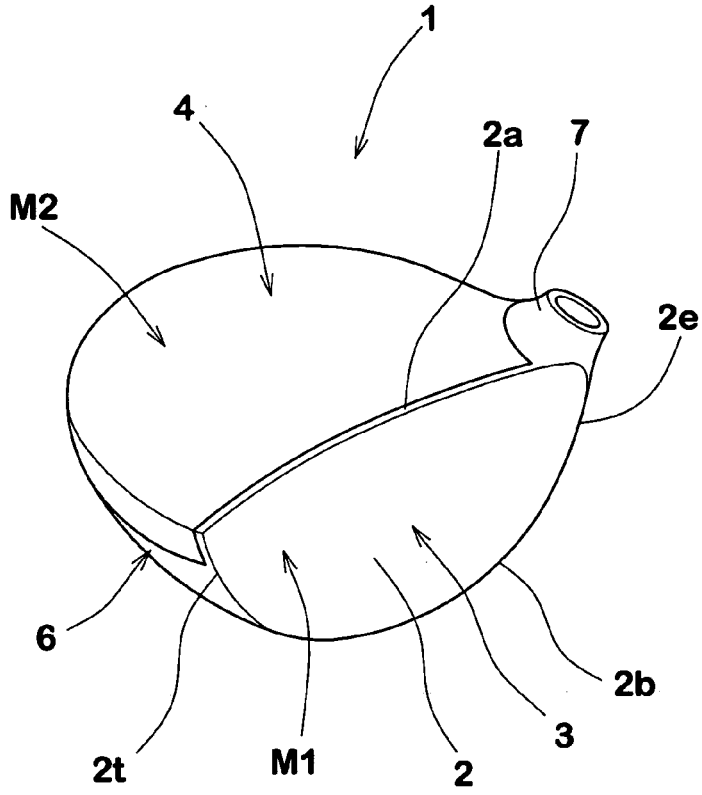
FIG. 1 is a perspective view of a wood-type golf club head according to the present invention.
Figure 2:
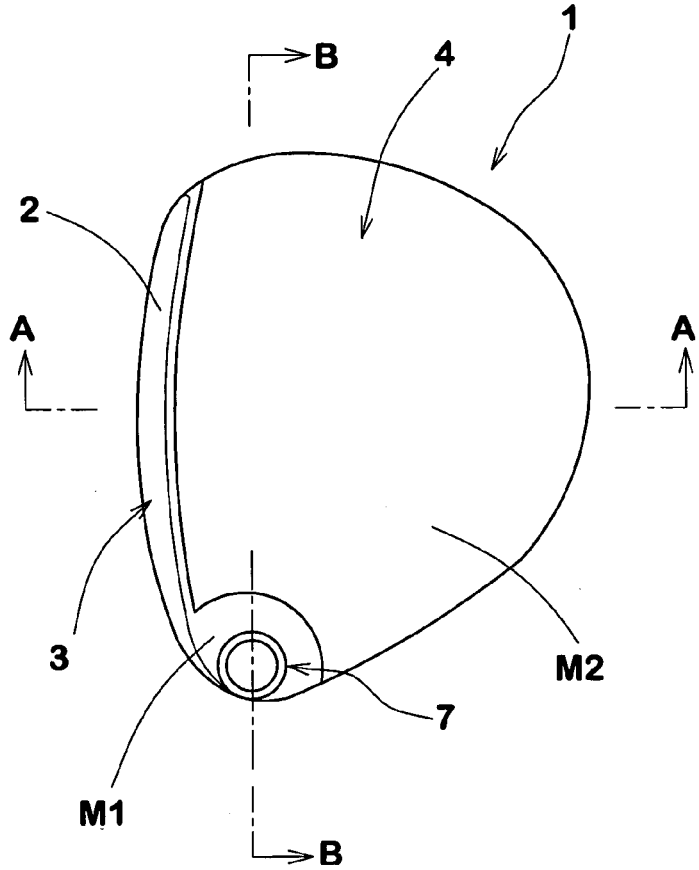
FIG. 2 is a top view thereof.

Embodiments of the present invention will now be described in detail in conjunction with the accompanying drawings.

In the drawings, club head 1 according to the present invention is a wood-type club head such as #1 driver and fairway wood. The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*t* to a heel-side edge 2*e* of the club face 2 through the back face of the club head; and a neck portion 7 to be attached to an end of a club shaft (not shown).

The volume of the club head 1 is set in a range of not less than 300 cc, preferably not less than 350 cc, more preferably 350 to 600 cc, still more preferably 370 to 550 cc. The head 1 has a cavity (i) immediately behind the face portion 3, and in the following embodiments, the cavity (i) is left void although it is also possible to fill it with a light-weight material such as foamed plastic, foamed rubber or the like. The combination of such a large head volume and hollow structure can improve the ball hitting sound because it can enhance high-frequency components of the ball hitting sound, and prolong the reverberation time of such enhanced sound.

For example, when the head volume of more than 300 cc, the depth GL of the center of gravity is preferably set in the range of not less than 35 mm, preferably not less than 37 mm, more preferably not less than 38 mm, but not more than 43 mm. The height GH of the center of gravity G is preferably set in the range of not less than 25 mm, but not more than 35 mm, preferably not more than 32 mm, more preferably not more than 30 mm. In case of a club head all made of metal material(s), it is very difficult to make a club head having such specifications, while achieving practical durability. However, according to the present invention, it is easy to make such a golf club head. By setting the depth GL of the center of gravity more than 35 mm, the sweet spot area of the head is remarkably increased, and the directionality may be improved. Further, as the height GH of the center of gravity is low, it becomes easer to decrease the backspin and to increase the launching angle of the ball and thereby to obtain an ideal ballistic course.

Figure 20:
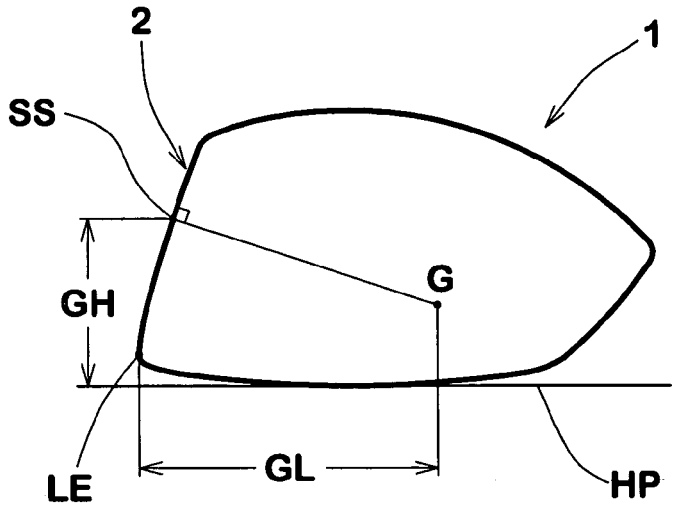
FIG. 20 is a diagrammatic cross sectional view of a head for explaining the depth of the center of gravity and the sweet spot height of a club head.
Figure 21:
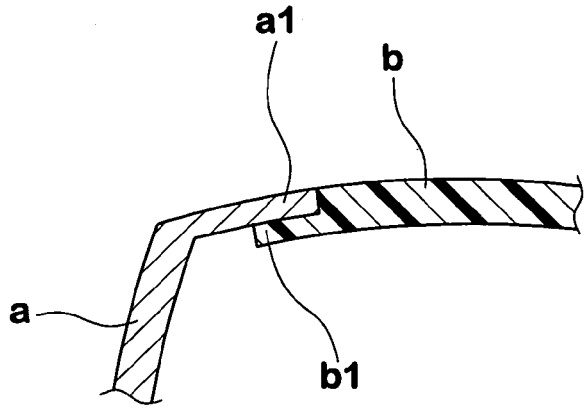
FIG. 21 is a cross sectional view showing a conventional joint between a metal part and a FRP part.

Here, as shown in FIG. 20, the depth GL of the center of gravity G is the horizontal distance between the center of gravity G and the leading edge LE of the head 1 measured in the standard state. The standard state is such that the club head is set on a horizontal plane HP satisfying its lie angle and loft angle. The height GH of the center of gravity G (or sweet spot height) is a vertical height GH measured from the horizontal plane HP to the sweet spot SS in the standard state. The sweet spot SS is defined as a point at which a straight line drawn normally to the club face 2 from the center of gravity G intersects the club face 2.

The club head 1 is composed of a metal part M1 and a FRP part M2 attached to the metal part M1.

The metal part M1 comprises a face wall 9, a sole wall 10 and a side wall 11 forming at least part of the face portion 3, sole portion 5 and side portion 6, respectively, and the neck portion 7, whereby its top is opened and the metal part M1 has an opening O1.

Figure 5:
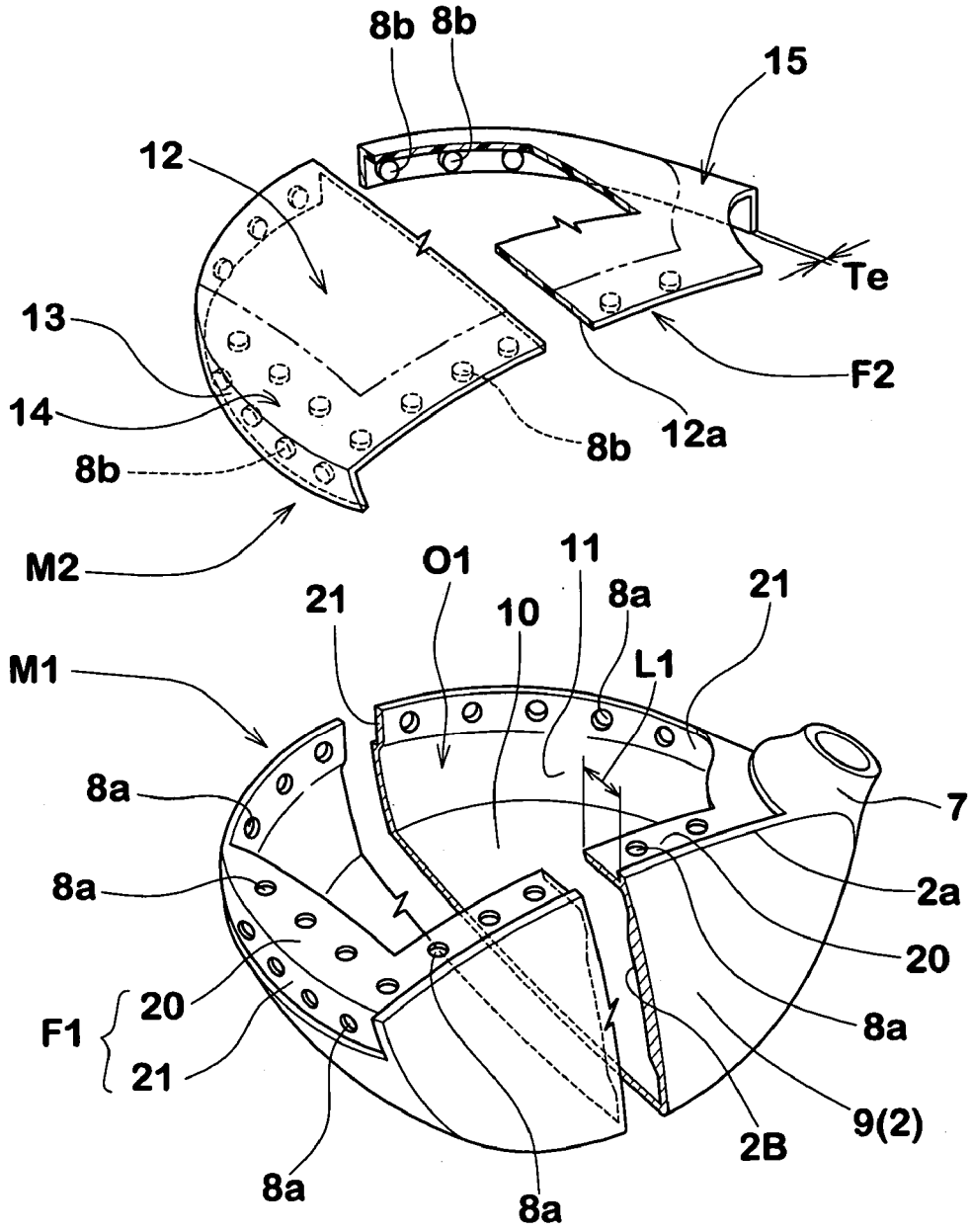
FIG. 5 is an exploded perspective view showing a metal part and a FRP part.
Figure 8:
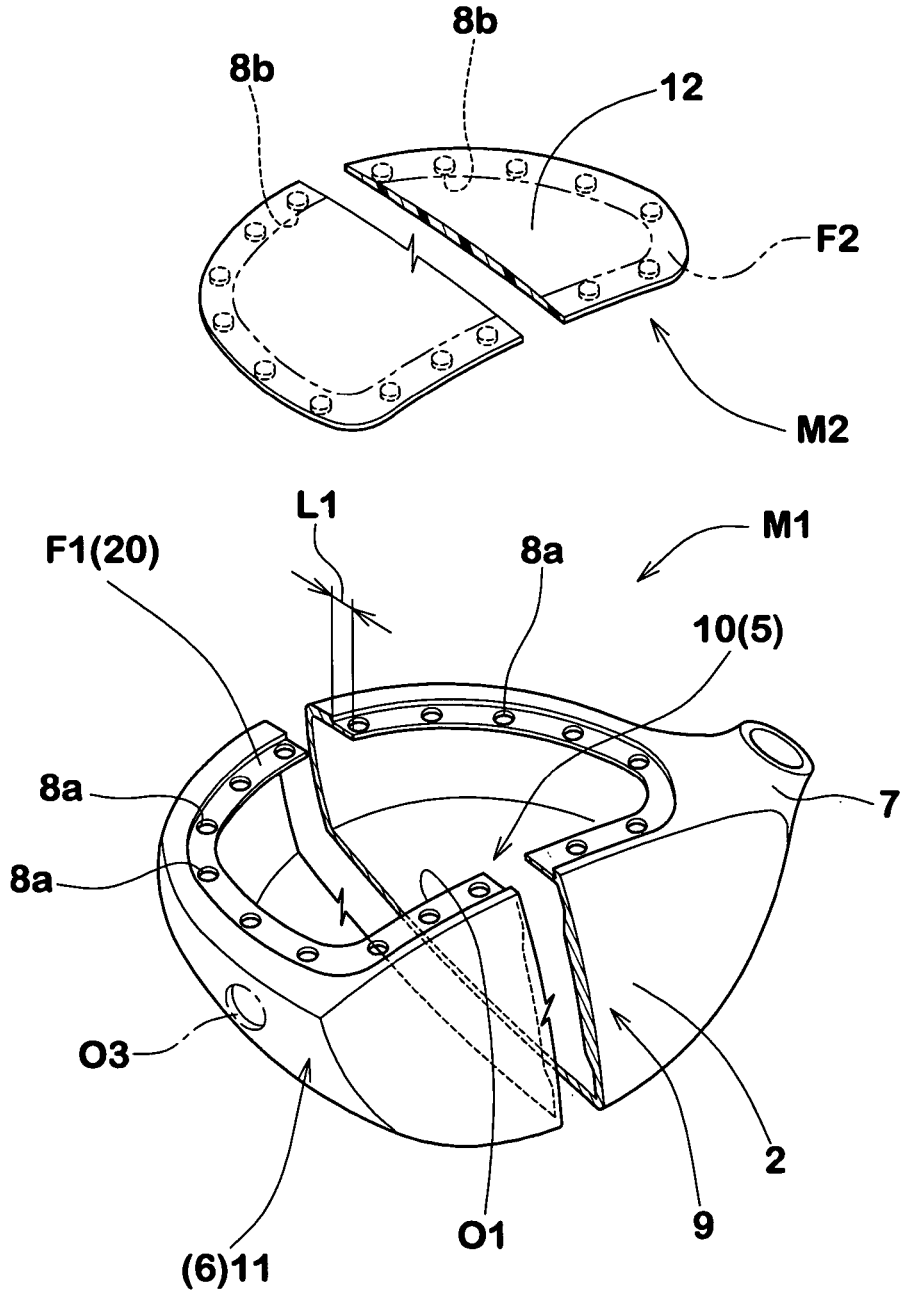
FIG. 8 is an exploded perspective view showing another example of the metal part and FRP part.

The metal part M1 is made of at least one kind of metal material having a large specific tensile strength. For example, titanium alloys such as alpha+beta titanium alloys and beta titanium alloys are preferred. Specifically, Ti-6Al-4V, Ti-4.5Al-3V-2Fe-2Mo, Ti-2Mo-1.6V-0.5Fe-4.5Al-0.3Si-0.03C, Ti-15V-3Cr-3Al-3Sn, Ti-15Mo-5Zr-3Al, Ti-15Mo-5Zr-4Al-4V, Ti-15V-6Cr-4Al, Ti-20V-4Al-1Sn and the like can be preferably used. However, aside from titanium alloys, various metal materials, e.g. aluminum alloy, pure titanium, stainless steel and the like can be used. The metal part M1 shown in FIGS. 5 and 8 is formed as a casting of a metal material, e.g. Ti-6Al-4V, utilizing a lost-wax precision casting method.

The face wall 9 is to form at least 60% of the club face 2 in area, also forming the entire thickness from the club face 2 to the back face 2B. In this example, in view of the durability and high-pitched hitting sound, the face wall 9 forms substantially 100% of the club face 2.

The thickness of the face wall 9 or face portion 3 can be a substantially constant value. But, in this embodiment, to achieve a balance between durability and rebound performance, the thickness is increased in a central region 9*a* in comparison with the surrounding peripheral zone 9*b*.

The thickness Tc in the central region 9*a* is set in a range of not less than 2.5 mm, preferably more than 2.7 mm, but not more than 3.0 mm, preferably less than 2.9 mm.

The thickness Tp in the peripheral zone 9*b* is set in a range of not less than 2.0 mm, preferably more than 2.3 mm, but not more than 2.5 mm.

It is preferable that the peripheral zone 9*b* has such a width that the area of the peripheral zone 9*b* is in a range of about 20% to about 50% of the area of the central region 9*a*.

The sole wall 10 extends backwards from the lower edge of the face wall 9 to form at least a major front part of the sole portion 5. In view of the durability of the head, the area thereof is preferably set in a range of at least 60%, more preferably at least 80% (in this embodiment 100%) of the sole portion 5, and the thickness Ts of the sole wall 10 or sole portion 5 is preferably set in a range of not less than 0.9 mm and not more than 3.0 mm, more preferably more than 1.2 mm but less than 2.0 mm.

The side wall 11 extends upwards from the edge of the sole wall 10 along the entire length of the edge continuously from the toe-side edge to the heel-side edge of the face wall 9 through the back face. The thickness Tb thereof is preferably set in the range of not less than 0.8 mm, more preferably more than 1.0 mm, but not more than 6.0 mm, more preferably less than 5.0 mm to achieve a balance between strength or durability and a large moment of inertia around the center of gravity.

The metal part M1 is provided around the above-mentioned opening O1 with a first lap joint part F1 which overlaps with a second lap joint part F2 of the FRP part.

If there is a ridge line E or edged boundary between the crown portion 4 and side portion 6, the side wall 11 is made somewhat lower in vertical height than the ridge line E.

In the metal part M1 shown in FIGS. 3-7, the first lap joint part F1 includes, as best seen in FIG. 5, a crown joint part 20 and a side joint part 21.

In the metal part M1 shown in FIG. 8, the first lap joint part F1 is a crown joint part 20 only.

The crown joint part 20 is formed as a part of the crown portion 4 around the opening O1.

Figure 6:
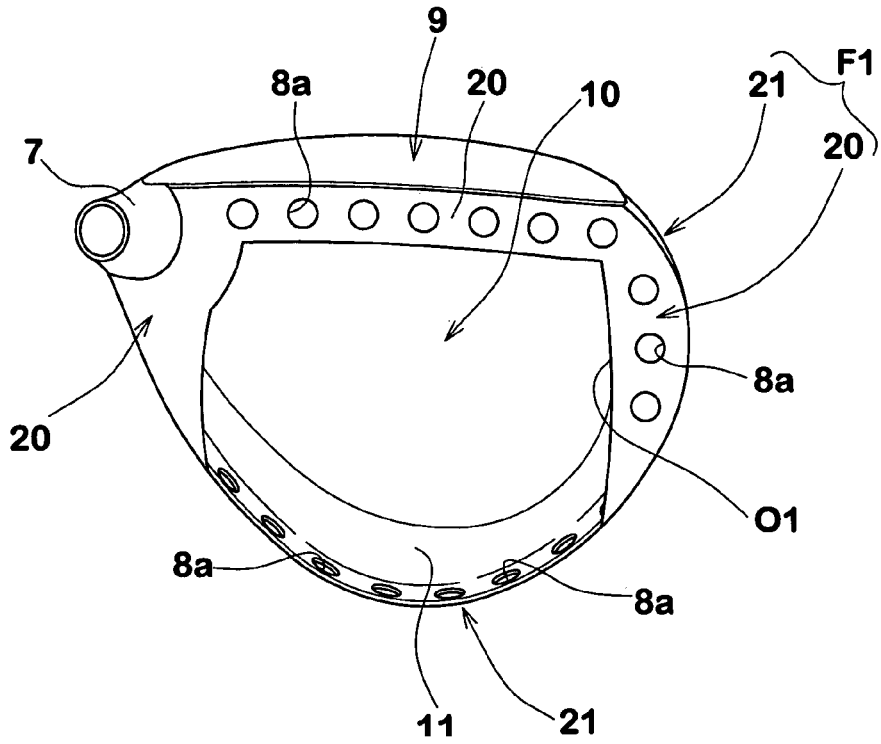
FIG. 6 is a top view of the metal part.
Figure 7:
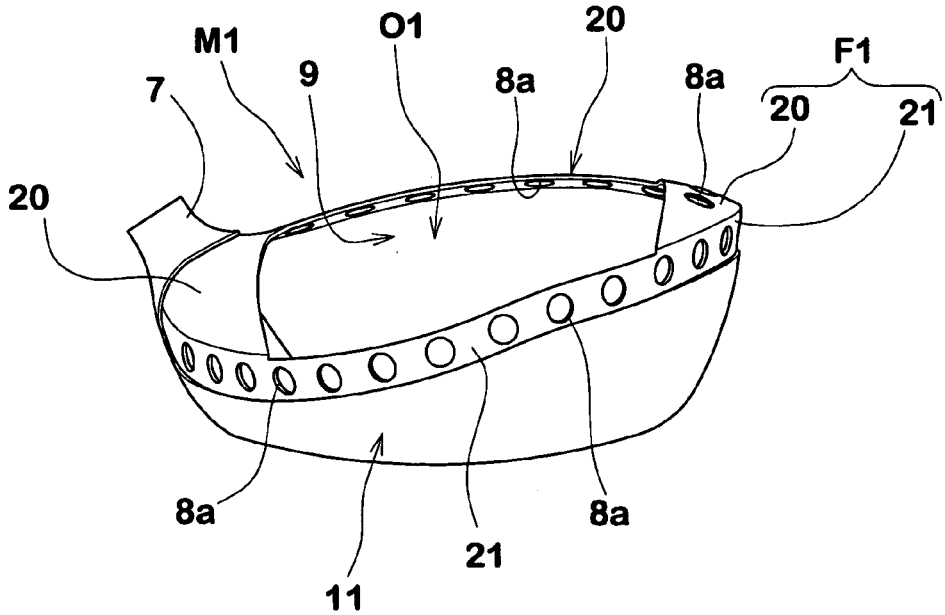
FIG. 7 is a back view thereof.

In FIGS. 3-7, the side joint part 21 is formed as an upper part of the side wall 11, and extends along the upper edge of the side wall 11 continuously from the toe to the heel through the back face of the head. The crown joint part 20 extends along: a toe-side part of the upper edge of the side wall 11; the entire length of the upper edge 2*a* of the face wall 9; and a heel-side part of the upper edge of the side wall 11, through and around the neck portion 7 as best seen in FIG. 6.

The crown joint part 20 and side joint part 21 are sunken from the adjacent outer surface through a step corresponding to the thickness of the FRP part M2 so that the outer surface of the FRP part M2 becomes flush with the outer surface of the metal part M1 at the boundary therebetween.

FIG. 8 shows another example of the metal part M1. In this example, the metal part M1 is composed of the above-mentioned face wall 9 (face portion 3), sole wall 10 (sole portion 5), side wall 11 (side portion 6) and neck portion 7, and further a periphery part of the crown portion 4, whereby this metal part M1 has an opening O1 within the crown portion 4. The first lap joint part F1 is circularly formed around the opening O1 within the crown portion 4, namely, as described above, it is made up of a crown joint part 20 only.

If the crown joint part 20 is too narrow in width, the bonding strength to the FRP part M2 becomes insufficient. If too wide, the weight unnecessarily increases. Therefore, the width L1 is set in the range of not less than 5.0 mm, preferably not less than 8.0 mm, more preferably not less than 12.0 mm, but not more than 25.0 mm, preferably not more than 20.0 mm. Here, the width L1 is a minimum distance across the objective part.

In the example shown in FIGS. 3-7, the width L1 is almost constant in a part along the face wall 9, but, in a part along the side wall 11, the width gradually decreases towards the backside as shown in FIG. 6. In the example shown in FIG. 8, the width L1 is almost constant along the entire circumference.

In order to engage with the undermentioned protrusions 8*b* of the FRP part M2, the first lap joint part F1 of the metal part M1 is provided with a plurality of securing holes 8*a*. The securing hole 8*b* is preferably a through-hole, and usually a circular hole as shown in FIGS. 3-9.

Figure 10:
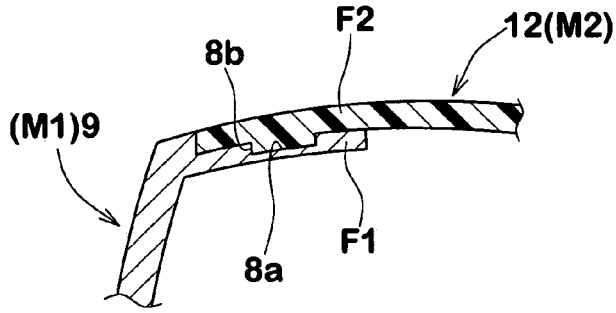

However, all or some of the securing holes 8*b* may be a blind hole having a closed inner end as shown in FIG. 10.

In view of securing or engaging force, the depth of such a blind hole is set to be not less than 0.5 mm, preferably more than 0.8 mm. The upper limit therefor depends on the thickness of the first lap joint part F1. Therefore, to prevent thickening of the lap joint, the depth is limited to under about 2.0 mm, preferably under 1.5 mm.

In cases of blind hole, it may be formed in a shape of a groove extending continuously or discontinuously along the edge of the opening O1.

Figure 11:
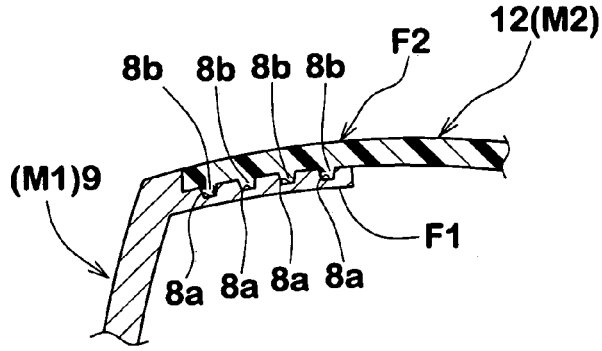

FIG. 11 shown an example wherein relatively narrow grooves (blind holes 8*b*) are disposed parallel with each other.

When the metal part M1 is formed using a mold like a casting, the holes 8*a* may be formed during the molding or casting process. It is also possible to form the holes 8*a* by machining, after molding, utilizing a numerical controlled machine tool for example. In anyway, by making the securing holes in the first lap joint part of the metal part, the corresponding weight reduction is possible.

As described above, as the face portion is made of a metal material, the ball hitting sound becomes a high-pitched sound, and by the large head volume and hollow structure, the reverberation time thereof is prolonged. Thus the club head can give an impression of good shot to the player.

The above-mentioned FRP part M2 is to cover the above-mentioned opening O1 of the metal part M1. Thus, the FRP part M2 has a crown wall 12 which forms the almost entirety of the surface of the crown portion 4.

Figure 3:
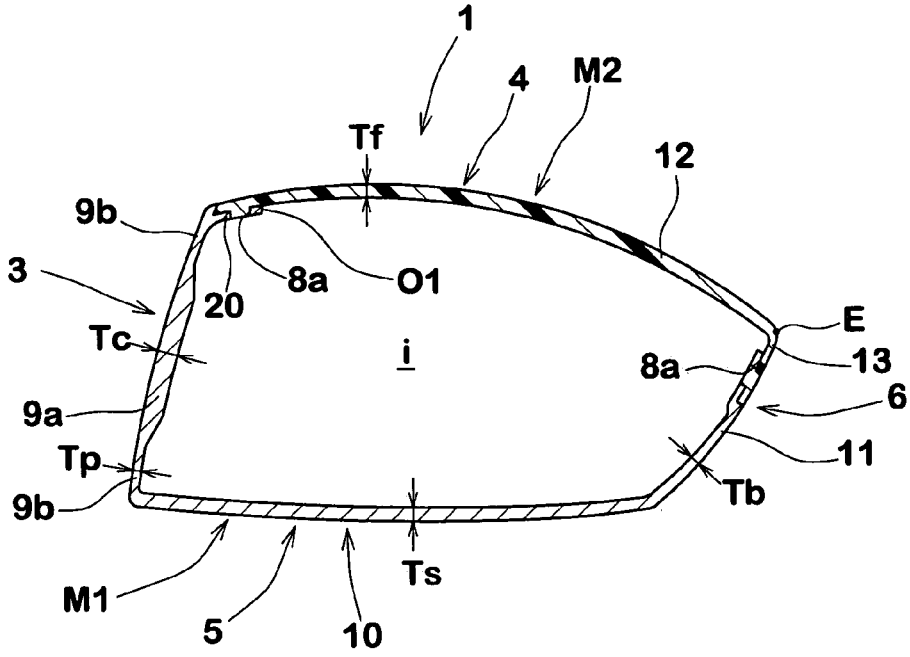
FIG. 3 is a cross sectional view taken on line A-A in FIG. 2.
Figure 4:
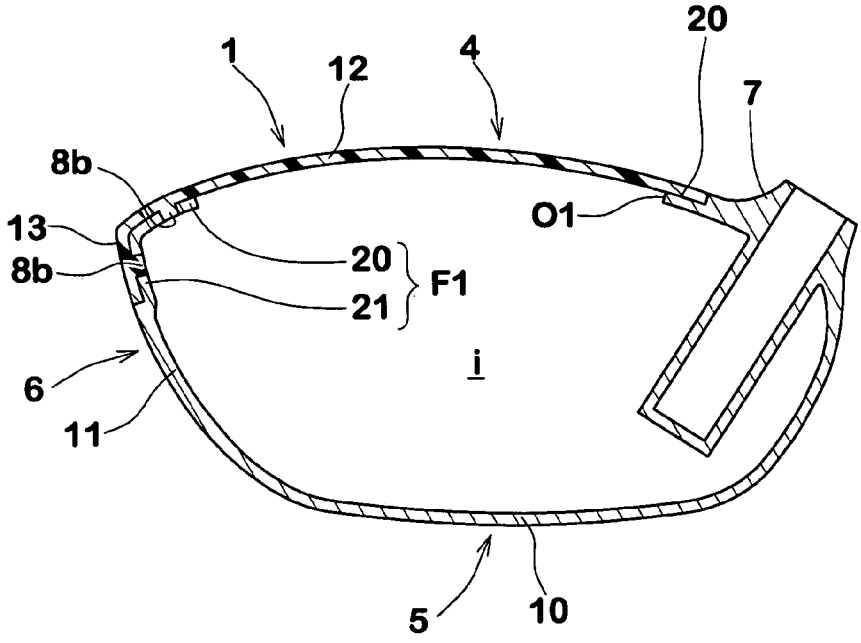
FIG. 4 is a cross sectional view taken on line B-B in FIG. 2.

In the example shown in FIGS. 3-5, the FRP part M2 is provided with a flange 13 which forms the surface of an upper part of the side portion 6. Thus, the flange 13 extends downward from the edge of the crown wall 12 excluding the front edge and neck portion, thus it extends continuously from the toe to the heel. In order to keep out of the neck portion 7, the crown wall 12 is provided with a cutout whose plan view corresponds to about one-third of a circle.

In the example shown in FIG. 8, the FRP part M2 is made up of a crown wall 12 only.

The FRP part M2 is made of a fiber reinforced resin including fibers.

Preferably, fibers having a tensile modulus of elasticity of not less than 200 GPa, more preferably not less than 240 GPa, still more preferably not less than 290 GPa are used. Especially, fibers having a modulus of from 290 to 500 GPa are preferred. To give actual examples, the following carbon fibers may be suitably used.

TABLE 1

(Carbon fibers)

| Manufacturer | Tensile modulus of elasticity ton/sq.mm | GPa |
|---|---|---|
| Mitsubishi Rayon Co., Ltd. | | |
| TR50S | 24.5 | 240.3 |
| MR40 | 30 | 294.2 |
| HR40 | 40 | 392.3 |

TABLE 1-continued (Carbon fibers)

| Manufacturer | Tensile modulus of elasticity ton/sq.mm | GPa |
|---|---|---|
| Toray Industries, Inc. | | |
| T700S | 23.5 | 230.5 |
| T300 | 23.5 | 230.5 |
| T800H | 30 | 294.2 |
| M30SC | 30 | 294.2 |
| M40J | 38.5 | 377.6 |
| M46J | 46 | 451.1 |
| T700G | 25.5 | 249.9 |
| M30S | 30 | 294.2 |
| TOHO TENAX Co., Ltd. | | |
| UT500 | 24.5 | 240.3 |
| HTA | 24 | 235.4 |
| IM400 | 30 | 294.2 |
| Nippon Graphite Fiber | | |
| YS-80 | 80 | 784.5 |

Here, the tensile modulus of elasticity is measured according to Japanese Industrial standard R 7601-1986 "Testing methods for carbon fibers".

The fibers in the FRP part M2 may be oriented toward one direction or dispersed in the resin in random orientation. But, in this example, the fibers are oriented toward orthogonal directions. As to the resin, various resins can be used. In this example, a thermosetting resin such as epoxy resin is used.

The thickness Tf of the crown wall 12 is set in the range of not less than 0.2 mm, preferably not less than 0.5 mm, more preferably not less than 0.8 mm, but not more than 3.0 mm, preferably not more than 2.5 mm, more preferably not more than 2.0 mm.

The thickness Te of the flange 13 is set in the range of not less than 0.2 mm, preferably not less than 0.5 mm more preferably not less than 0.7 mm, but not more than 2.0 mm, preferably not more than 1.5 mm, more preferably not more than 1.2 mm.

The FRP part M2 is provided with a second lap joint part F2 which makes a lap joint, together with the first lap joint part F1.

In the example shown in FIGS. 3-7, the second lap joint part F2 includes a front portion, toe-side portion and heel-side portion of the crown wall 12 as indicated in FIG. 5 in imaginary line, and the flange 13. Thus, on the toe-side and heel-side of the head, the lap joint 14, 15 bridges between the crown portion 4 and side portion 6. Such a bridging part can increase the joint strength and the strength of the FRP part.

In the example shown in FIG. 8, the second lap joint part F2 is a circular periphery portion of the crown wall 12 as indicated in imaginary line.

The second lap joint part F2 is provided with protrusions 8*b*. In order that the protrusions 8*b* can fit to the above-mentioned securing holes 8*a* provided on the first lap joint part F1, the positions and shapes thereof are so determined.

Figure 13B:
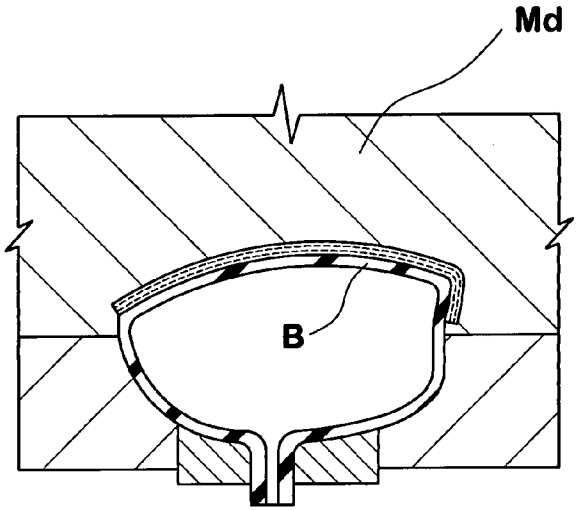
FIGS. 13(*a*) and 13(*b*) are cross sectional views for explaining a method of manufacturing a FRP part.
Figure 13A:
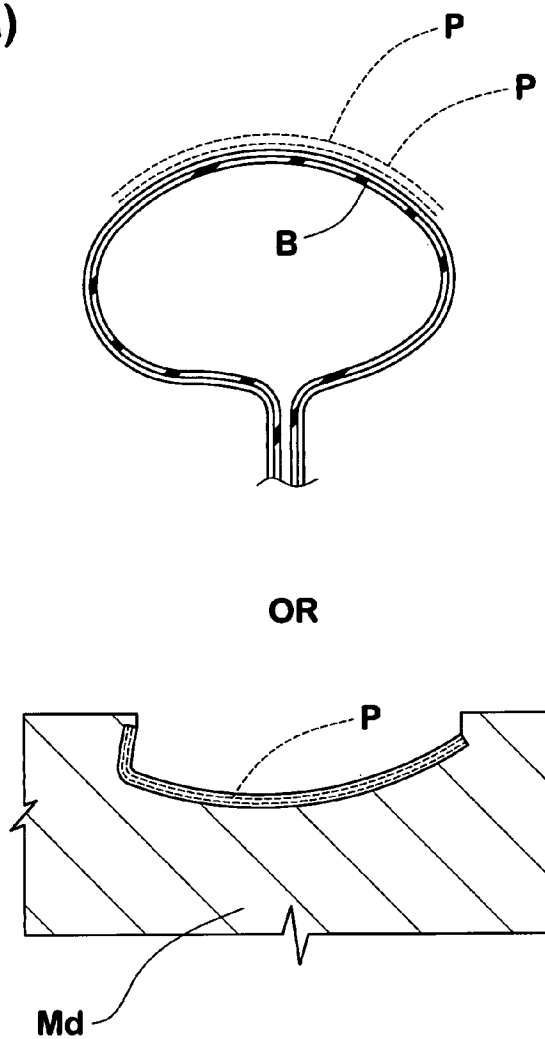

In order to make the FRP part M2, a molding method using prepregs can be employed, for example as shown in FIGS. 13(*a*) and 13(*b*). Firstly, as shown in FIG. 13(*a*), prepregs P are applied to the outer surface of an inflatable bladder B made of for example rubber or alternatively to the inner surface of the mold Md. The bladder is set in a mold Md, and inflated to press the prepregs onto the inside of the mold. The mold Md is heated to harden the resin. After hardened, the prepregs are demolded, and unnecessary part is trimmed, and according to need, protrusions 8*b* and/or holes 8*a* are formed in the second lap joint part F2 by bonding the protrusions with hot-melt adhesive for example, drilling the holes 8*a* and the like. In view of variation of the thickness or an intended change (design change) in the thickness, the use of the bladder B is preferred because of its higher compatibility.

The prepreg P is as well known in the art a combination of continuous reinforcing fibers that are preimpregnated with a thermoset or thermoplastic organic resin matrix. In this example, epoxy resin is used as a matrix resin. The fibers in a prepreg P may be oriented toward one direction or orthogonal directions. The prepreg is cut into a specific shape. By laying predetermined number of prepreg sheets one on top of another to have a required thickness, the prepregs are shaped into a specific shape, and the matrix resin is hardened. In case of unidirectional orientation, prepregs P are arranged such that the fibers in a prepreg cross those in the adjacent prepreg. Preferably, the resin content is set in a range of about 20 to 25%.

Here, the resin content is a percentage of the weight of the resin component to the overall weight of the object. The resin content can be obtained as follows. To separate the fibers, the resin matrix is removed from the measuring object by chemically dissolving the resin matrix only. If the measuring object is uncured prepreg, as the chemical, for example methyl ethyl ketone may be used. If the measuring object is a cured FRP material, for example hot nitric acid may be used. Then by subtracting the weight of the fibers from the total weight of the measuring object, the weight of the resin matrix can be obtained.

In addition to the methods using prepregs, an injection molding method using a fluid compound material of short fibers, a resin matrix and additives can be employed to eliminate the need to form the protrusion 8*b* in separate operation.

After the FRP part M2 and the metal part M1 are made as discrete parts, they are assembled by lap jointing the first and second lap joint parts F1 and F2 with applying an adhesive agent to therebetween and inserting the protrusions 8*b* into the securing holes 8*a*.

If the holes 8*a* and protrusion 8*b* are too small, it is difficult to improve the shearing strength of the lap joint. If too large, the bonding area of the lap joint becomes decreased and it is difficult to obtain necessary strength and durability. Therefore, the maximum diameter D of the hole 8*a* and protrusion 8*b* is preferably set in the range of not less than 2.0 mm, more preferably not less than 3.0 mm, but not more than 8.0 mm, more preferably not more than 5.0 mm.

In addition to a circle, the holes 8*a* and protrusions 8*b* can be formed in a shape of an ellipse, elongated circle, polygon and the like. Thus, in case of not round shape, it is preferable to limit the hole in terms of the volume, instead of the diameter D. The volume of a hole 8*a* is set in a range of not less than 1.5 cu.mm, preferably not less than 5.6 cu.mm, but not more than 102.0 cu.mm, preferably not more than 30.0 cu.mm. Also it is preferable that the percentage of the total area S1 of all the holes 8*a* to the overall area S of the lap joint part F1 or F2 including the total area S1 is set in the range of not less than 20%, preferably not less than 30%, but not more than 70%, preferably not more than 60%. As a result, a balance between the adhesion force by the adhesive agent and the mechanical engaging force by the protrusion 8*b* and holes 8*a* can be achieved, and the strength of the joint can be remarkably increased.

Figure 12:
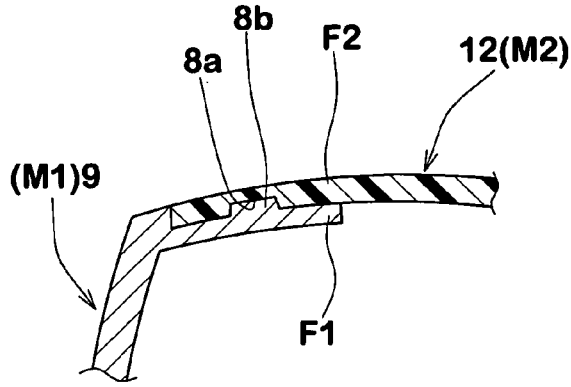

Reversely to the above examples, as shown in FIG. 12, it is possible to form the holes 8*a* on the second lap joint part F2, and the protrusions 8*b* on the first lap joint part F1.

Further, it is possible to form both of the holes 8*a* and protrusions 8*b* on each of the first and second lap joint parts F1 and F2.

Figure 9:
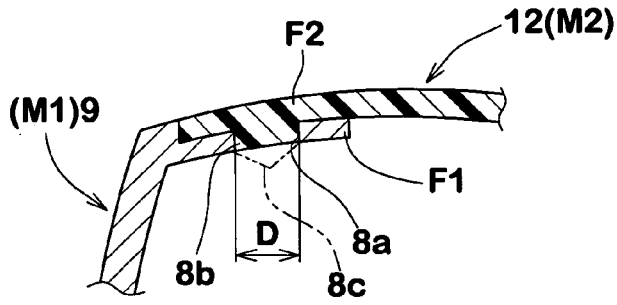
FIGS. 9, 10, 11 and 12 are cross sectional views showing various combinations of the securing holes and protrusions in the lap joint between the metal part and FRP part.

Furthermore, as shown in FIG. 9 in imaginary line, a retainer 8*c* larger than the hole 8*a* may be formed at the end of the protrusion 8*b* in order to increase the resistance to pulling-out.

Figure 14:
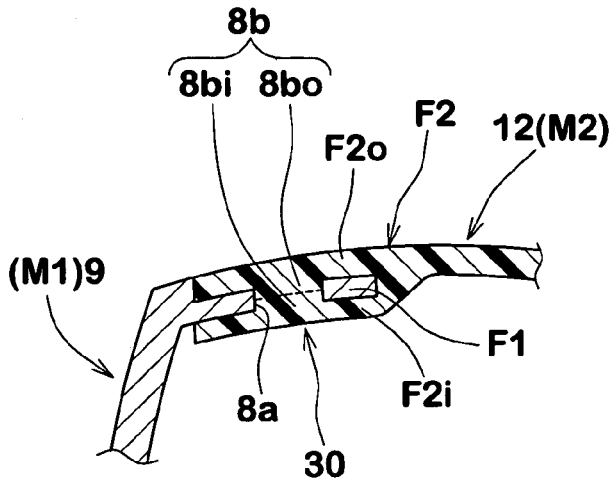
FIG. 14 is a cross sectional view showing another example of the lap joint wherein the FRP part is two-forked.

FIG. 14 shows a modification of the above-mentioned second lap joint part F2 which may be adopted in every type of FRP part M2, but preferably combined with the first lap joint part F1 with the through-hole type securing holes 8*a*.

In this example, the second lap joint part F2 is two-forked in the cross section, namely, this part F2 is provided with an inner lip F2*i* which is positioned on the inside of the first lap joint part F1, and thus the first lap joint part F1 is held between the inner lip F2*i* and the outside part F2*o* on the outside of the first lap joint part F1.

When this two-forked type second lap joint part F2 is formed on the above-mentioned discrete-type FRP part M2, it is preferable that the outside part F2*o* is provided with downwardly or inwardly protruding outer protrusions 8*bo*, and the inner lip F2*i* is provided with upwardly or outwardly protruding inner protrusions 8*bi*. In the respective securing holes 8*a*, the outer protrusions 8*bo* confront with the respective inner protrusions 8*bi*, and they are bonded each other.

In the above description, the FRP part M2 is first formed separately from the metal part M1, and they are integrated by bonding the lap joint parts F1 and F2.

It is however, also possible to do the formation of the FRP part M2 and its integration with the metal part M1 concurrently within a mold as follows.

Figure 15:
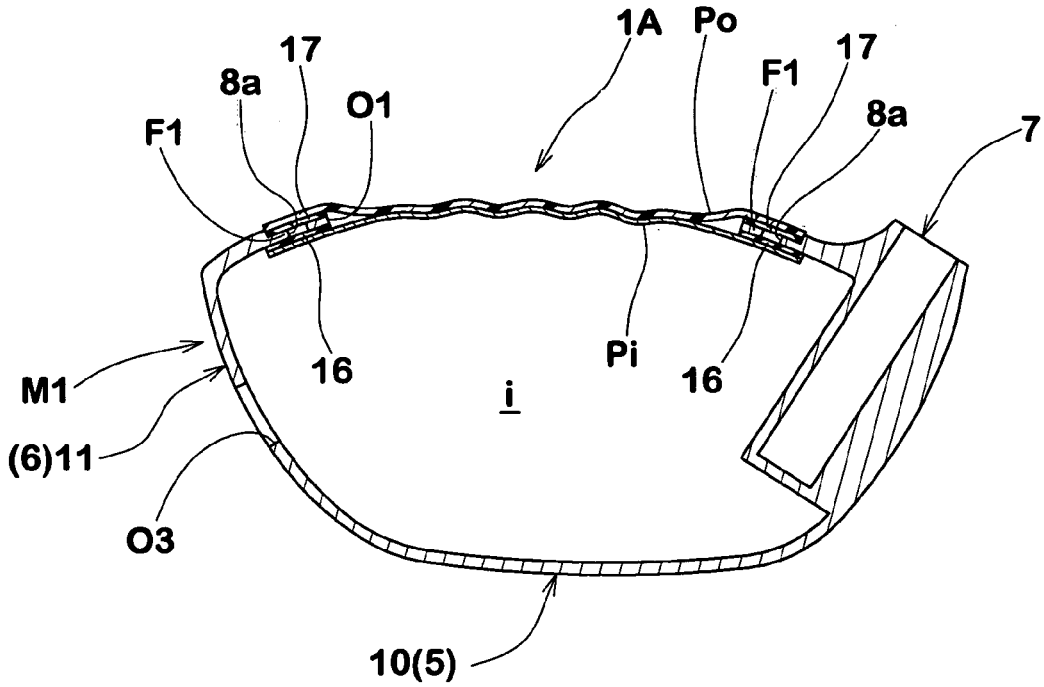
FIGS. 15, 16 and 17 are cross sectional views showing a method of molding and concurrently integrating a FRP part.

Firstly, the metal part M1 is made, wherein a through hole O3 which is utilized to insert a bladder B into the hollow (i) of the metal part M1 is provided in an appropriate position, for example, in the side wall 11 on the toe side as shown in FIG. 15 in full line and FIG. 8 in imaginary line.

Then, an inside prepreg Pi is applied to the inner surface of the first lap joint part F1 as shown in FIG. 15. In this example, the inside prepreg Pi is a sheet having such a size and shape being capable of completely covering the opening O1. The peripheral part of the inside prepreg Pi is temporarily fixed to the inside of the first lap joint part F1, using the adhesive agent 16. To apply and locate the inside prepreg Pi accurately, a rod, lever or the like inserted in the through hole O3 can be used. Instead, an inflatable bladder inserted into the hollow (i) can be used to press the inside prepreg Pi onto the first lap joint part F1.

On the outside of the inside prepreg Pi, an outside prepreg Po is applied to the outer surface of the first lap joint part F1 so as to completely cover the opening O1. The outside prepreg Po is a single sheet having a size and shape being capable of completely covering the opening O1. Between the peripheral part of the outside prepreg Pi and the outer surface of the first lap joint part F1, an adhesive agent 17 is again used to temporarily fix each other.

In this example, between the inside prepreg Pi and outside prepreg Po, an adhesive agent is not used. But, if need be, it is possible to use an adhesive agent.

For the adhesive agents 16, 17, those having superior adhesiveness between the metal material of the metal part M1 and the matrix resin in the inside and outside prepreg Pi and Po, for example, heat-hardening adhesive agents such as epoxy resin adhesives are preferably used.

Figure 16:
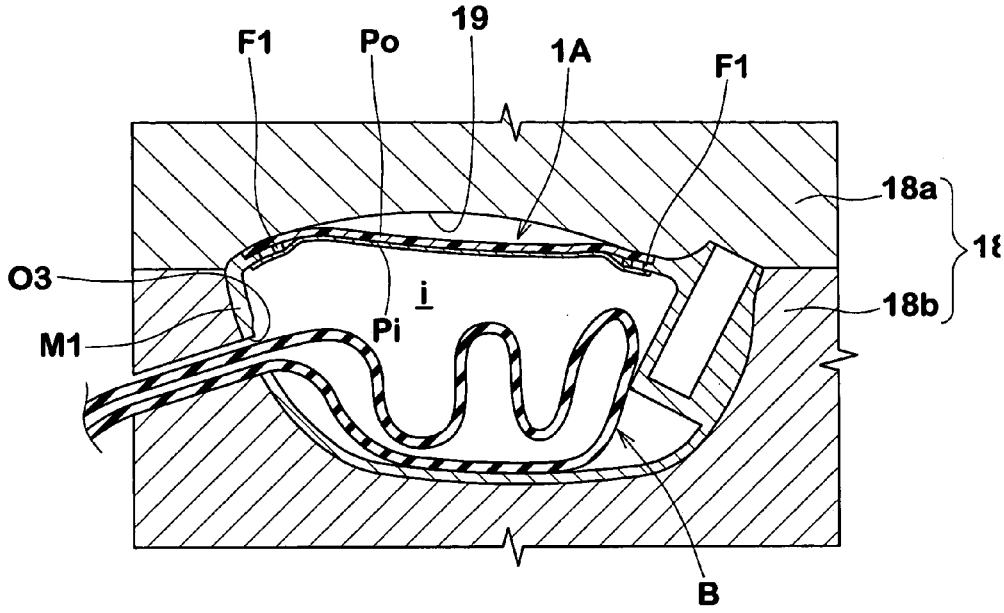
Figure 17:
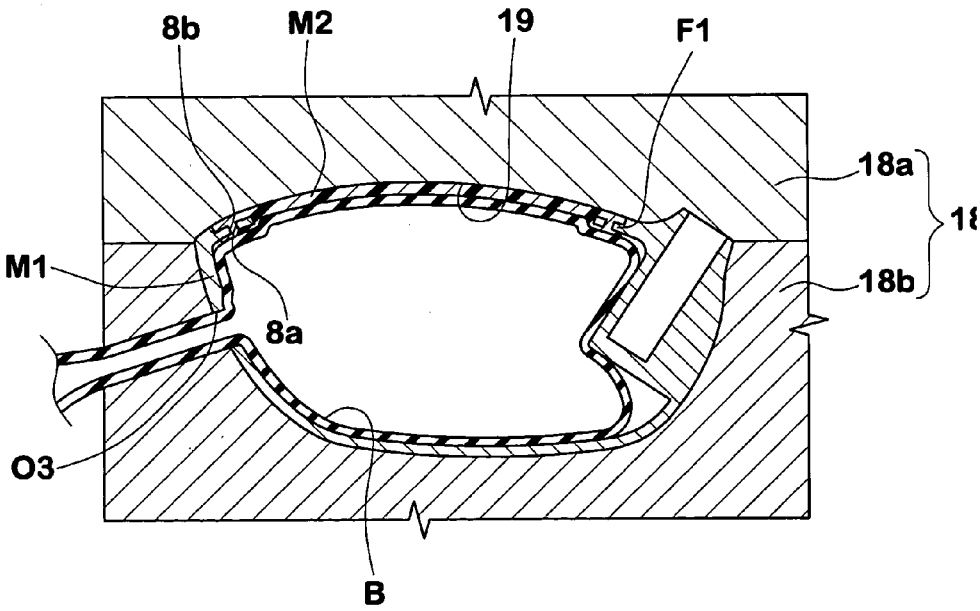

As shown in FIG. 16, the metal part M1 and prepreg Pi and Po are set in a split mold 18 which comprises for example a upper piece 18*a* and a lower piece 18*b*. In the mold 18, the prepregs Po and Pi are heated up to a temperature enough to make plastic deformation, a highly expandable bladder B which is as shown in FIG. 16 put in the hollow (i) through the through hole O3 is inflated by a high-pressure high-temperature gas or steam as shown in FIG. 17. Thus, the expanded bladder B compress the inside prepreg Pi and outside prepreg Po between the surface of the bladder B and the molding face 19 or inner surface of the mold 18*a*. AS the matrix resin in the prepregs Pi, Po is in a plasticized state, the resin flows to fit to the first lap joint part F1 of the metal part M1, and the resin flows into the securing holes 8*b* and is hardened to form the protrusions 8*b*. The matrix resins of the directly contacting inside and outside prepreg Pi and Po are merged and hardened. Thus, they are strongly adhered with each other or integrated.

For that purpose, the content of the resin in each prepreg, namely, that in the FRP part M2 is set in the range of not less than 15%, preferably not less than 20%, but not more than 35%, preferably not more than 30%, more preferably not more than 25% when the matrix resins is fully hardened, the bladder B is deflated and pulled out from the hollow (i). The club head 1 is demolded. The through hole O3 is patched to close.

By the method of molding and integrating a FRP part, the bonding strength between the metal part M1 and FRP part M2 and the durability can be greatly improved.

This method can be employed to make the FRP part M2 without the inner lip F2*i* as shown in FIG. 9 to 12. In such a case, the inside prepreg Pi is omitted.

Figure 18:
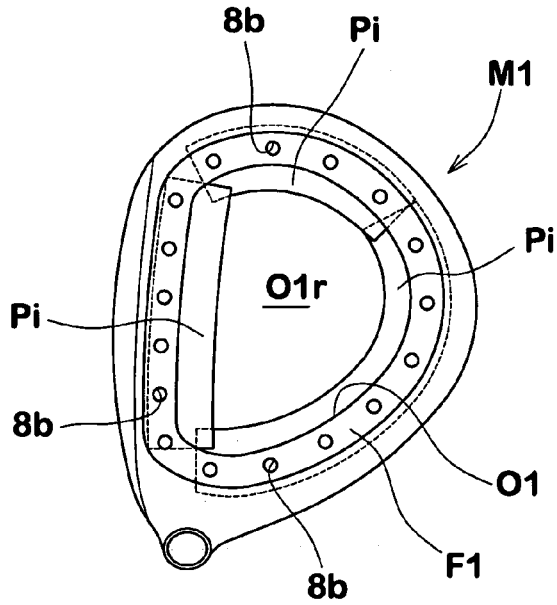
FIG. 18 is a top view of the metal part to which prepreg tapes forming the FRP part are applied.

FIG. 18 shows another example of the inside prepreg Pi, which is a plurality of relatively short tapes which are applied along the edge of the opening O1 so that for example, its half width protrudes into the opening O1. Thus, the opening O1 is not closed completely. Accordingly, using the remaining opening part O1*r*, the inside prepreg Pi can be easily applied to the inside of the first lap joint part F1. Aside from the tapes having two ends, the inside prepreg Pi in a form of endless ring may be also used.

In the above examples, the metal part M1 is made of one kind of a metal material, and formed as an integral part. But, it is possible to use two or more kinds of metal materials, and the metal part M1 can be formed by assembling two or more parts which are formed by suitable methods, e.g. casting, forging, pressing, rolling, cutting and the like. As a modification of the above-described metal part M1, it can be made of two or more metal materials having different specific gravity. For example, the sole wall 10 may be formed of a different metal material having a larger specific gravity than the other portion.

Figure 19:
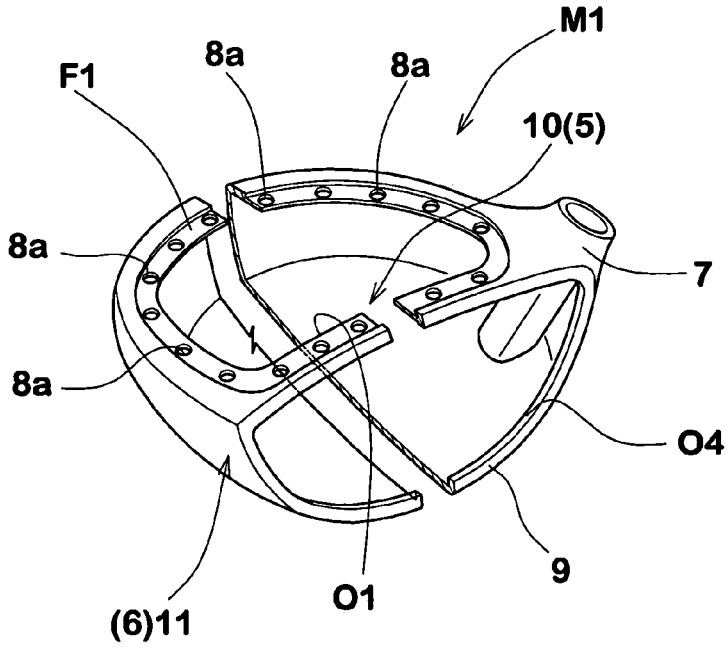
FIG. 19 is an exploded perspective view showing another example of the metal part whose face portion is formed by a separate face plate.

FIG. 19 shows such a modification of the metal part M1 similar to the FIG. 8 example, wherein, in stead of the above-mentioned integrated face wall 9, a separate face plate (not shown) is used to form the face portion 3, and thus a front opening O4 which is closed by the attached face plate is formed. Therefore, this front opening O4 can be used to apply the inside prepreg Pi and to insert the bladder B, and thus there is no need to make the above-mentioned opening O3. In this example, the metal part M1 is formed as a casting of a metal material similarly to the former examples shown in FIGS. 5 and 8. But, the face plate is formed by forging a titanium alloy.

In the above embodiments, as described above, as the specific gravity of the FRP part M2 is smaller than the metal part, the weight of the club head can be reduced to redistribute the reduced weight to the sole portion 5 and/or side portion 6 for example. Accordingly, the design freedom is greatly increased which makes it possible to lower and deepen the center of gravity and to increase the moment of inertia of a relatively large-sized hollow club head.

Comparison Tests (Discrete Type Club Head)

Wood-type golf club heads having the same outer shapes shown in FIG. 1 and a head volume of 400 cc and specifications shown in Table 2 were made and tested for the durability, traveling distance of the ball, and hitting sound.

The metal parts had the structure shown in FIG. 5 and were made as a lost-wax precision casting of Ti-6Al-4V. The thickness distribution was as follows.

Face Wall 9 (Face Portion 3)

Thickness Tc in the central region 9*a:* 2.8 mm

Thickness Tp in the peripheral zone 9*b:* 2.0 mm

Peripheral zone area/central region area: 20%

Sole Wall 10 (Sole Portion 5)

Thickness Ts: 1.3 mm

Side Wall 11 (Side Portion 6)

Thickness Tb: 1.0 mm

The securing holes were a 3.0 mm dia. circular hole, including a through-hole and blind-hole.

The ratio (S1/S) of the total area S1 of the securing holes to the overall area S of the first or second lap joint part F1, F2 was changed by changing the number of the securing holes. In Ref., the first and second lap joint parts were not provided with the securing holes and protrusions.

The FRP parts were made by using prepregs as shown in FIG. 13(*b*). The thickness distribution is as follows.

Crown Wall 12 (Crown Portion 4)

Thickness Tf: 0.8 mm

Thickness Te: 0.8 mm

The prepregs used were carbon fiber prepregs: T-700S (resin: 37 weight %), T-800H (resin: 30 weight %), and M-40J (resin: 33 weight %) manufactured by Toray Industries Inc. which were used in combination so that the average resin content became 33%. The metal part and FRP part were fixed with an epoxy resin adhesive.

Durability Test

The club heads were attached to identical FRP shafts to make 45-inch wood clubs. Each club was mounted on a swing robot, and three-piece balls (MAXFLI HI-BRID, Sumitomo Rubber Ind., Ltd.) were struck at a head speed of 54 meter/second, and the joint part and club face were visually checked for damage and/or deformation at every 1000 times hitting up to 9000 times.

The number of hitting times at which the junction was broken is shown in Table 2.

Ball Traveling Distance Test

Each of the clubs was mounted on a swing robot, and three-piece balls (MAXFLI HI-BRID, Sumitomo Rubber Ind., Ltd.) were struck at a head speed of 45 m/s five times at the sweet spot to obtain the mean traveling distance (carry plus run).

The results are indicated in Table 2 by an index based on Ref.A1 being 100, wherein the larger the index number, the longer the traveling distance.

Hitting Sound Test (Feeling Test)

With those wood clubs, fifty average golfers having handicaps ranging from 15 to 25 struck the golf balls, and by the golfers' feeling the hitting sound was evaluated into five ranks from a point of view of whether the hitting sound was a favorable high-pitched sound. The higher the rank number, the more the favorable high-pitched sound. The results are shown in Table 2.

TABLE 2

| Club Head | Ref. A1 | Ex. A1 | Ex. A2 | Ex. A3 | Ex. A4 | Ex. A5 |
|---|---|---|---|---|---|---|
| Securing hole | none | | | | | |
| Shape | — | circle | circle | circle | circle | circle |
| Type | — | blind | through | through | through | through |
| Depth (mm) | 0 | 0.5 | 0.8 | 0.8 | 0.8 | 1.2 |
| S1/S (%) | 0 | 30 | 30 | 60 | 10 | 80 |
| Center of gravity | | | | | | |
| Depth (mm) | 34 | 36 | 36 | 37 | 34.5 | 37 |
| Height (mm) | 39 | 30 | 27 | 25 | 35 | 26 |
| Durability | | | | | | |
| Number of hits | 600 | 5800 | 6400 | 7900 | 1300 | 2400 |
| Condition *1 | C | C | C | C | C | C |
| Ball traveling distance | 100 | 102 | 102.5 | 103 | 101 | 102.8 |
| Hitting sound | 3 | 4 | 5 | 5 | 4 | 4 |

*1 "C": Lap joint was broken in the crown portion.

From the test results, it was confirmed that the durability can be remarkably improved, while also improving the hitting sound and traveling distance.

Comparison Tests (Integral Type Club Head)

According to the method described in connection with FIGS. 15 to 18, wood-type golf club heads having the same outer shapes shown in FIG. 1 and a head volume of 400 cc were made and tested for the durability, traveling distance of the ball, and hitting sound as explained above.

To make the club head 1, the metal parts shown in FIGS. 5 and 8 were first made as a lost-wax precision casting of Ti-6Al-4V, and they were used. AS to the FRP parts, the outside and inside prepregs were used to form the two-forked part in EX.B13 only. In the rest, only the outside prepreg was used. The specifications of the prepregs used are shown in Table 3. To temporarily fix the prepreg to the meal part, an epoxy resin adhesive was used.

The test results are also shown in Table 3.

From the test results, it was confirmed that the durability can be improved more than the above-mentioned discrete type club heads, and the hitting sound also has a tendency to be improved more than the discrete type club heads, while also improving the traveling distance.

The present invention can be applied to not only wood-type club heads but also iron-type, patter-type club heads.

TABLE 3

| Club head | Ref. B1 | Ex. B1 | Ex. B2 | Ex. B3 | Ex. B4 | Ex. B5 | Ex. B6 | Ex. B7 |
|---|---|---|---|---|---|---|---|---|
| Metal part | FIG. 5 | FIG. 5 | FIG. 5 | FIG. 5 | FIG. 5 | FIG. 5 | FIG. 5 | FIG. 5 |
| Securing hole | none | | | | | | | |
| Shape | — | circle | circle | circle | circle | circle | circle | circle |
| Type | — | blind | through | through | through | through | through | through |
| Depth (mm) | 0.5 | 0.8 | 0.8 | 0.8 | 1.2 | 0.8 | 0.8 | 0.8 |
| Area ratio S1/S (%) | 0 | 30 | 30 | 60 | 10 | 80 | 20 | 70 |
| FRP part | | | | | | | | |
| Resin content (weight %) | 24 | 24 | 24 | 24 | 24 | 24 | 24 | 24 |
| Prepreg (Table 1) | T700G | T700G | T700G | T700G | T700G | T700G | T700G | T700G |
| Inner lip F2i | none | none | none | none | none | none | none | none |
| Center of gravity | | | | | | | | |
| Depth (mm) | 34 | 36 | 36 | 37 | 34.5 | 37 | 35.5 | 37 |
| Height (mm) | 39 | 30 | 27 | 25 | 35 | 26 | 31 | 25 |
| Durability | | | | | | | | |
| Number of hits | 900 | 8600 | 9000 | 9000 | 3100 | 6700 | 9000 | 9000 |
| Condition *1 | C | C | no damage | no damage | C | C | no damage | no damage |
| Traveling distance | 100 | 102 | 103 | 103 | 101.5 | 103 | 102 | 102.5 |
| Hitting sound | 3 | 4 | 5 | 5 | 4 | 4 | 5 | 5 |

| Club head | Ex. B8 | Ref. B2 | Ex. B9 | Ex. B10 | Ex. B11 | Ex. B12 | Ex. B13 |
|---|---|---|---|---|---|---|---|
| Metal part | FIG. 8 | FIG. 8 | FIG. 5 | FIG. 5 | FIG. 5 | FIG. 5 | FIG. 5 |
| Securing hole | | none | | | | | |
| Shape | circle | — | circle | circle | circle | circle | circle |
| Type | through | — | through | through | through | through | through |
| Depth (mm) | | 0.8 | 0.8 | 0.8 | 0.8 | 0.8 | |
| Area ratio S1/S (%) | 30 | 0 | 30 | 30 | 30 | 30 | 10 |
| FRP part | | | | | | | |
| Resin content (weight %) | 24 | 24 | 20 | 30 | 35 | 42 | 24 |
| Prepreg (Table 1) | T700G | T700G | M30S | T700S | T700S | T700S | T700G |
| Inner lip F2i | none | none | none | none | none | none | entire circumferentce |

TABLE 3-continued

| | | | | | | | |
|---|---|---|---|---|---|---|---|
| Center of gravity | | | | | | | |
| Depth (mm) | 36 | 32 | 34 | 34 | 36 | 36 | 35 |
| Height (mm) | 28 | 41 | 27 | 30 | 32 | 34 | 32 |
| Durability | | | | | | | |
| Number of hits | 2900 | 300 | 7700 | 9000 | 9000 | 9000 | 9000 |
| Condition *1 | C | C | C | no damage | no damage | no damage | no damage |
| Traveling distance | 102.5 | 100 | 103 | 103 | 102.5 | 102 | 101.5 |
| Hitting sound | 5 | 5 | 5 | 5 | 4 | 4 | 4 |

*1 "C": Lap joint was broken in the crown portion.

The invention claimed is:

1. A hollow golf club head composed of a metal part made of at least one kind of metal material and a FRP part made of a fiber reinforced resin, the metal part having a first lap joint part, and the FRP part having a second lap joint part lap-jointed with the first lap joint part, wherein one of the first lap joint part and second lap joint part is provided with at least one securing hole, and the other is provided with at least one protrusion engaging with said at least one securing hole, wherein said at least one securing hole is a plurality of holes having a total area S1 in a range of not less than 20% of the overall area S of the lap joint.

2. The golf club head according to claim 1, wherein the metal part includes a face wall which forms the club face for hitting a ball.

3. The golf club head according to claim 1, wherein the first lap joint part of the metal part is provided with said at least one securing hole, and the second lap joint part is provided with said at least one protrusion.

4. The golf club head according to claim 1, wherein the metal part has an opening on the top thereof, and the FRP part covers the opening and forms at least a part of a crown portion of the head.

5. The golf club head according to claim 4, wherein the first lap joint part is formed continuously along the entire circumference of the opening, and the second lap joint part is formed continuously along the entire circumference of the FRP part.

6. The golf club head according to claim 4, wherein the FRP part comprises a crown wall forming a crown portion, and a flange extending downwards from an edge of the crown wall to form the surface of an upper part of the side portion of the head.

7. The golf club head according to claim 6, wherein the second lap joint part includes a part bridging between the crown wall and flange.

8. The golf club head according to claim 6, wherein both the crown wall and flange in the bridging part are provided with the protruson and/or securing hole.

9. The golf club head according to claim 1, wherein the head volume is in a range of from 370 to 550 cc, the height of the center of gravity of the head in a range of from 25 to 35 mm, and the depth of the center of gravity of the head in a range of from 35 to 43 mm.

10. The golf club head according to claim 1, wherein the total area S1 is not less than 30% of the overall area S.

11. The golf club head according to claim 1, wherein the total area S1 is not more than 70% of the overall area S.

12. The golf club head according to claim 1, wherein the total area S1 is not more than 60% of the overall area S.

13. The golf club head according to claim 1, wherein the securing hole and protrusion have a diameter of not less than 3 mm.

14. The golf club head according to claim 13, wherein the diameter is not more than 8 mm.

15. The golf club head according to claim 13, wherein the diameter is not more than 5 mm.

16. The golf club head according to claim 1, wherein said at least one protrusion is formed integrally with the FRP part from the fiber reinforced resin thereof.

17. The golf club head according to claim 1, wherein each said protrusion is provided at the end thereof with a retainer larger than the securing hole.

18. A hollow golf club head composed of a metal part made of at least one kind of metal material and a FRP part made of a fiber reinforced resin, the metal part having a first lap joint part, and the FRP part having a second lap joint part lap-jointed with the first lap joint part, wherein one of the first lap joint part and second lap joint part is provided with at least one securing hole, and the other is provided with at least one protrusion engaging with said at least one securing hole, and the second lap joint part of the FRP part includes: an inside part abutting on the inside of the first lap joint part; and an outside part abutting on the outside of the first lap joint part to have a two-forked cross sectional shape.

19. A hollow golf club head composed of a metal part made of at least one kind of metal material and a FRP part made of a fiber reinforced resin, the metal part having a first lap joint part, and the FRP part having a second lap joint part lap-jointed with the first lap joint part, wherein one of the first lap joint part and second lap joint part is provided with at least one securing hole, and the other is provided with at least one protrusion engaging with said at least one securing hole, wherein said at least one protrusion is formed integrally with the FRP part from said fiber reinforced resin, and each said securing hole is a through hole.

20. A hollow golf club head composed of a metal part made of at least one kind of metal material and a FRP part made of a fiber reinforced resin, the metal part having a first lap joint part, and the FRP part having a second lap joint part lap-jointed with the first lap joint part, wherein one of the first lap joint part and second lap joint part is provided with at least one securing hole, and the other is provided with at least one protrusion engaging with said at least one securing hole, wherein said at least one protrusion is formed integrally with the FRP part from said fiber reinforced resin, and the first lap joint part and second lap joint part are formed in both of a crown portion and a side portion of the head.

* * * * *